US011535446B2

(12) United States Patent
Mühlemann

(10) Patent No.: US 11,535,446 B2
(45) Date of Patent: Dec. 27, 2022

(54) CAPSULE HAVING AN INTEGRATED DISPENSING DEVICE

(71) Applicant: MÜHLEMANN IP GMBH, Stein am Rhein (CH)

(72) Inventor: Rolf Mühlemann, Schlattingen (CH)

(73) Assignee: Mühlemann IP GmbH, Stein am Rhein (CH)

( * ) Notice: Subject to any disclaimer, the term of this patent is extended or adjusted under 35 U.S.C. 154(b) by 249 days.

(21) Appl. No.: 16/956,113

(22) PCT Filed: Dec. 7, 2018

(86) PCT No.: PCT/EP2018/083984
§ 371 (c)(1),
(2) Date: Jun. 19, 2020

(87) PCT Pub. No.: WO2019/121066
PCT Pub. Date: Jun. 27, 2019

(65) Prior Publication Data

US 2021/0101741 A1 Apr. 8, 2021

(30) Foreign Application Priority Data

Dec. 20, 2017 (CH) ..... 01566/17

(51) Int. Cl.
*B65D 85/804* (2006.01)
*B65D 47/08* (2006.01)
*B65D 53/04* (2006.01)

(52) U.S. Cl.
CPC ..... *B65D 85/8043* (2013.01); *B65D 47/08* (2013.01); *B65D 53/04* (2013.01)

(58) Field of Classification Search
CPC ..... B65D 85/8046; B65D 47/0804; B65D 43/26; B65D 51/18; B65D 51/22;
(Continued)

(56) References Cited

U.S. PATENT DOCUMENTS 4,247,001 A * 1/1981 Wiegner ..... B65D 81/3222 215/DIG. 8
5,255,812 A * 10/1993 Hsu ..... B65D 51/2835 126/263.01

(Continued)

FOREIGN PATENT DOCUMENTS

CH 700312 A2 7/2010
CN 104395198 A 3/2015

(Continued)

OTHER PUBLICATIONS

International Search Report dated Feb. 13, 2019, for PCT/EP2018/083984 filed Dec. 7, 2018.

(Continued)

*Primary Examiner* — King M Chu
*Assistant Examiner* — Prince Pal
(74) *Attorney, Agent, or Firm* — Paul D. Bianco; Katharine Davis Wong; Fleit Intellectual Property Law

(57) ABSTRACT

A plastic capsule has an integrated dispensing device for a substrate accommodated in the plastic capsule. The capsule comprises a capsule body, an opening element and a capsule cover. The capsule body and the capsule cover define a capsule interior for the substrate, in which the opening element is arranged in such a way that the opening element can be moved toward the capsule cover. The capsule cover can be brought from a closed state into an open state by the opening element. The capsule cover has a peripheral fastening edge and a plurality of flaps, which are connected to the fastening edge by one hinge each, in particular a film hinge, the movement of the opening element toward the capsule cover causing a deflection of the flaps around the respective hinges.

20 Claims, 4 Drawing Sheets

(58) Field of Classification Search
CPC .... B65D 2251/0018; B65D 2251/0093; B65D 53/04; A47J 31/0689; A47J 31/407
USPC ..... 220/254.1, 359.1, 359.2, 262, 260, 265, 220/277, 278; 53/492
See application file for complete search history.

(56) References Cited

U.S. PATENT DOCUMENTS

| | | | | |
|---|---|---|---|---|
| 5,913,964 | A * | 6/1999 | Melton | B29C 51/32 99/279 |
| 6,003,728 | A * | 12/1999 | Elliott | B65D 47/0804 222/129 |
| 6,705,462 | B2 | 3/2004 | Kasuya | |
| 6,840,373 | B2 | 1/2005 | Gibler | |
| 6,886,686 | B2 | 5/2005 | Anderson | |
| 7,004,161 | B2 * | 2/2006 | Kolb | C09K 5/18 126/262 |
| 8,522,669 | B1 * | 9/2013 | Rolfes | B65D 85/8046 426/77 |
| 8,657,159 | B2 | 2/2014 | Nielsen | |
| 8,857,665 | B2 * | 10/2014 | Owoc | B65D 23/00 222/145.5 |
| 8,887,905 | B2 | 11/2014 | Muhlemann | |
| 9,145,251 | B2 * | 9/2015 | Minnette | A23L 3/04 |
| 9,327,881 | B1 | 5/2016 | Saranga et al. | |
| 9,499,305 | B2 | 11/2016 | Nielsen | |
| 9,574,921 | B2 * | 2/2017 | Nielsen | B05B 11/3015 |
| 9,751,667 | B2 | 9/2017 | Guery et al. | |
| 9,821,540 | B2 * | 11/2017 | Montuori | B32B 38/04 |
| 10,426,180 | B1 * | 10/2019 | Fonte | A23G 9/224 |
| 10,968,015 | B2 * | 4/2021 | Francoeur | A47G 21/00 |
| 11,273,975 | B2 * | 3/2022 | Junker | A47J 31/407 |
| 11,278,149 | B2 * | 3/2022 | Ulman | A47J 31/0689 |
| 2003/0172813 | A1 * | 9/2003 | Schifferle | B65D 85/8046 99/275 |
| 2003/0213709 | A1 * | 11/2003 | Gibler | B65D 51/2842 206/219 |
| 2008/0067172 | A1 | 3/2008 | Wilhelm | |
| 2011/0174642 | A1 * | 7/2011 | Coon | B65D 51/2835 215/228 |
| 2012/0258221 | A1 * | 10/2012 | Wong | B65D 85/8052 426/431 |
| 2012/0321748 | A1 * | 12/2012 | Otto | A47J 31/085 99/302 R |
| 2013/0214005 | A1 | 8/2013 | Nielsen | |
| 2014/0305817 | A1 * | 10/2014 | Guery | A61J 9/00 206/221 |
| 2015/0366236 | A1 * | 12/2015 | Inoue | B65D 51/18 249/177 |
| 2016/0123786 | A1 * | 5/2016 | Hanna | B65D 51/18 220/254.2 |
| 2016/0207664 | A1 | 7/2016 | Nielsen | |
| 2016/0214787 | A1 * | 7/2016 | Iotti | B65D 85/8049 |
| 2018/0360255 | A1 * | 12/2018 | Ye | B65D 85/8043 |
| 2019/0047771 | A1 * | 2/2019 | Mühlemann | B65D 85/8049 |
| 2019/0357564 | A1 * | 11/2019 | Yang | A23G 9/28 |
| 2020/0121115 | A1 * | 4/2020 | Oh | A47J 31/0652 |

FOREIGN PATENT DOCUMENTS

| | | | |
|---|---|---|---|
| EP | 2700589 | A2 | 2/2014 |
| WO | 2003/093128 | A1 | 11/2003 |
| WO | 2006/046730 | A1 | 5/2006 |
| WO | 2012/048922 | A1 | 4/2012 |
| WO | 2017/114583 | A1 | 7/2017 |

OTHER PUBLICATIONS

Written Opinion for PCT/EP2018/083984 filed Dec. 7, 2018.
First Office Action dated Aug. 23, 2021, for CN 2018800824968, issued by the China National Intellectual Property Administration (with English translation).
International Preliminary Report dated Jun. 23, 2020 with Written Opinion, for PCT/EP2018/083984 filed Dec. 7, 2018 (English translation).

* cited by examiner

CAPSULE HAVING AN INTEGRATED DISPENSING DEVICE

TECHNICAL FIELD

The invention relates to a capsule or a container, in particular a plastic capsule or a plastic container, with integrated dispensing device.

TECHNICAL BACKGROUND

Known from WO2012048922, CH700312, WO2006046730, WO03093128, U.S. Pat. Nos. 6,705,462, 6,886,686, 4,247,001 and US2008067172 is a respective plastic capsule, which in a capsule chamber has an integrated dispensing device for dispensing substrates received into the capsule container chamber into a mixing container. The plastic capsule is often designed as a container seal, or is placed on a mixing container opening during use. During activation of the dispensing device, the substrate is dispensed from the capsule chamber into the mixing container.

The plastic capsules each comprise a capsule body, an opening means, e.g., in the form of an ejector, and a sealing film. The capsule body here forms the capsule interior or the capsule chamber for receiving solid or liquid substrates, for example solid, free-flowing, or liquid agents, beverage additives, reagents, etc., which is sealed by the sealing film. The ejector is movably incorporated into the capsule interior in such a way that activating the ejector moves the latter in the direction of the sealing film, cutting through the sealing film in the process. The substrate received in the capsule interior can exit the capsule. The ejector can be activated by means of a flexible, curved membrane, or a portion of the ejector is airtightly guided through the capsule wall and directly activatable.

U.S. Pat. No. 6,003,728 shows an alternative to the sealing film. The capsule chamber is here sealed with a lower closing cover that can be pushed open instead of the sealing film, which is non-positively received in a groove of the capsule wall by means of a circumferential bead. The closing cover can be connected with the capsule wall by a narrow hinged bridge, and protrudes essentially perpendicularly into the mixing container in the open position. The ejector acts centrally on the closing cover. For dispensing purposes, the closing cover must be pressed out of the latching connection with a relatively high level of exertion, and then "jumps" into the open position. It can here happen that the hinged bridge also breaks, and the closing cover falls into the mixing container.

The disadvantage to the known capsule systems is that the cut film or swiveled out closing cover often plunges into the liquid of the mixing container, and remains in this open position. It is then almost impossible to cleanly remove the plastic capsule from the mixing container. The structural design of the known capsules with integrated dispensing device is also most often complex and expensive. In addition, the sealing film cannot be torn or cut open in a controlled manner, so that handling the plastic capsule is prone to error. Another disadvantage to the known capsules is that the substrate is dispensed uncontrollably and often along the peripheral edge region. It can here happen, for example, that powdery or grainy substrate gets stuck to the interior surface of the container neck, and is not dispensed completely and cleanly into the mixing container.

DESCRIPTION OF THE INVENTION

One aspect of the invention relates to avoiding the mentioned disadvantages to prior art.

The disclosed plastic capsule with integrated dispensing device for a substrate received in the plastic capsule comprises a capsule body, an opening means, and a capsule cover. The capsule body and the capsule cover define a capsule interior for the substrate. In the capsule interior, the opening means is arranged so that it can move in the direction of the capsule cover. The capsule cover can be brought from a closed state or a closed position into an open state or an open position by way of the opening means. The capsule cover has a peripheral fastening edge and several flaps connected with the fastening edge by a respective hinge, wherein the movement of the opening means in the direction of the capsule cover deflects the flaps around the respective hinge.

Activating the opening means causes the flaps to swivel out, wherein the capsule cover begins to centrally open. The flaps themselves here act as ramps, which dispense the substrate centrally into the mixing container.

Preferred embodiment types of the invention are also disclosed.

In several embodiments, the several flaps can be formed by slits in the capsule cover or slits in the cover surface of the capsule cover, which comprise several sectors of the capsule cover. The sectors can be tapered sectors, the tips of which converge on the longitudinal axis of the capsule. These are preferably uniform or constant circle segments, so that a planar circular area of the capsule cover is divided into at least three identical circle segments. The capsule cover here opens from the middle, and thereby guarantees a controlled dispensing of the substrate. Webs that bridge the slits can be present between the flaps, and form predetermined breaking points. The slits can be replaced by thin segments, which tear open when the dispensing device is activated.

In several embodiments, the hinge can be designed in such a way that a restoring force acts on the flap in the open state of the capsule cover. For example, the hinge can take the form of an arc, in particular a circular arc. A restoring force here acts on the swiveled out, open flap, and after the opening means has been retracted, the flap moves back into the closed state. The capsule can now be cleanly removed from the mixing container.

In several embodiments, the opening means can comprise several arms uniformly arranged around a longitudinal axis of the opening means, wherein the several arms are preferably connected with each other at the ends facing the capsule cover via a ring.

In several embodiments, the opening means can have at least one front stop surface, which upon activation of the opening means presses against the several flaps, and causes these flaps to swivel out.

The stop surface can here also be comprised of several (partial) stop surfaces. The stop surface is preferably annularly shaped, or the several (partial) stop surfaces are annularly arranged. As a rule, each stop surface is here arranged radially inwardly offset in relation to a respective hinge.

This means that an annular stop surface is arranged offset radially inward in relation to the several film hinges, or the several annularly arranged stop surfaces are each arranged offset radially inward in relation to the several film hinges.

In other words, the diameter of an annular stop surface or several annularly arranged stop surfaces is smaller than the distance between the hinges and the midpoint of the annular shape. Preferably only slightly, so that the stop surface hits the flap as close to the film hinge as possible, but still far enough away from it to ensure that a sufficiently high lever action is present for pressing open the flaps. In this way, the flaps can also be swiveled out almost completely, i.e., by up to nearly 90° in relation to the planar starting position, by a slight movement of the opening means. With the opening means moved completely toward the front, the outward swiveling ideally measures at least 60°.

The ring that connects the several arms with each other can form the annular stop surface. Alternatively, the ring can be rearwardly offset relative to the end of the arm, so that the respective ends of the arms each form a partial stop surface for a respective flap.

In several embodiments, the capsule body has a capsule wall with an upper capsule edge that forms a capsule opening and a lower capsule bottom. The capsule body is preferably conical in design.

In several embodiments, the capsule bottom is designed as an outwardly curved and inward pushable membrane, which is operatively connected with the opening means. Pressing in the membrane here causes the opening means to move in the direction of the capsule cover. The latter is opened by virtue of the flaps being pressed away by the opening means and swiveled out around the hinge. As a rule, the curved capsule bottom is flexible enough as to return back into the outwardly curved initial position when released—i.e., when no force acts in the direction of the capsule cover. The flaps can then be closed once again by the restoring force.

In order to protect the curved capsule bottom against being inadvertently pressed in or inadvertently activated, the capsule body can have a skirt that circles around and protrudes over the capsule bottom. The capsule bottom is here inwardly offset in relation to the lower edge of the skirt, so that the capsule can be placed on the skirt without the capsule bottom being pressed in.

In several embodiments, the capsule bottom and opening means are connected with each other via respective coupling parts, so as to facilitate a closing of the flaps.

In several embodiments, the capsule cover can be retained on an interior surface in the area of the upper capsule edge, and a planar surface of the capsule cover can align flush with the upper capsule edge.

In several embodiments, the upper capsule edge can have an outwardly directed flange, to which a sealing film is preferably fastened.

In several embodiments, the opening means can be designed as an ejector.

In several embodiments, an upper edge of the capsule wall can be designed as an opening means, and the capsule body has an upper, peripheral border, which is connected with the capsule wall by a flexible connecting portion. The capsule cover is here fastened to the upper border. The flexible connecting portion permits a displacement of the upper border relative to the capsule wall and to the opening means, so that the upper edge presses open the flaps of the capsule cover. Such a plastic capsule or such a plastic container is described in the Swiss patent application entitled "Plastic Container with Opening Means" by the same applicant and with the same application date, the contents of which are hereby included in this application.

BRIEF DESCRIPTION OF THE FIGURES

The invention will be described in more detail below based on exemplary embodiments in conjunction with their drawing(s). Shown on.

WAYS OF IMPLEMENTING THE INVENTION

Figure 1:
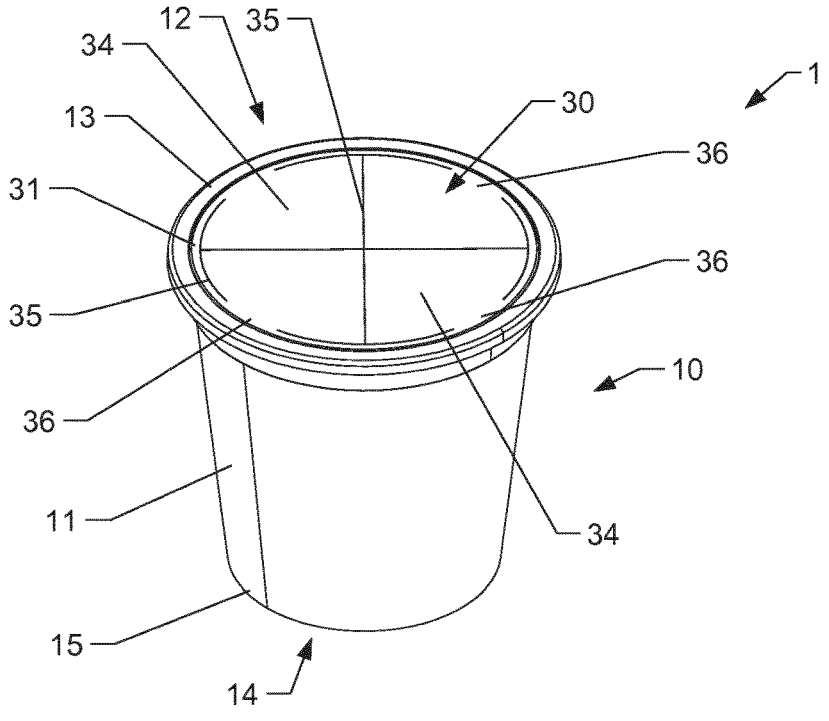
FIG. 1 is a perspective view of a plastic capsule with integrated dispensing device.
Figure 2:
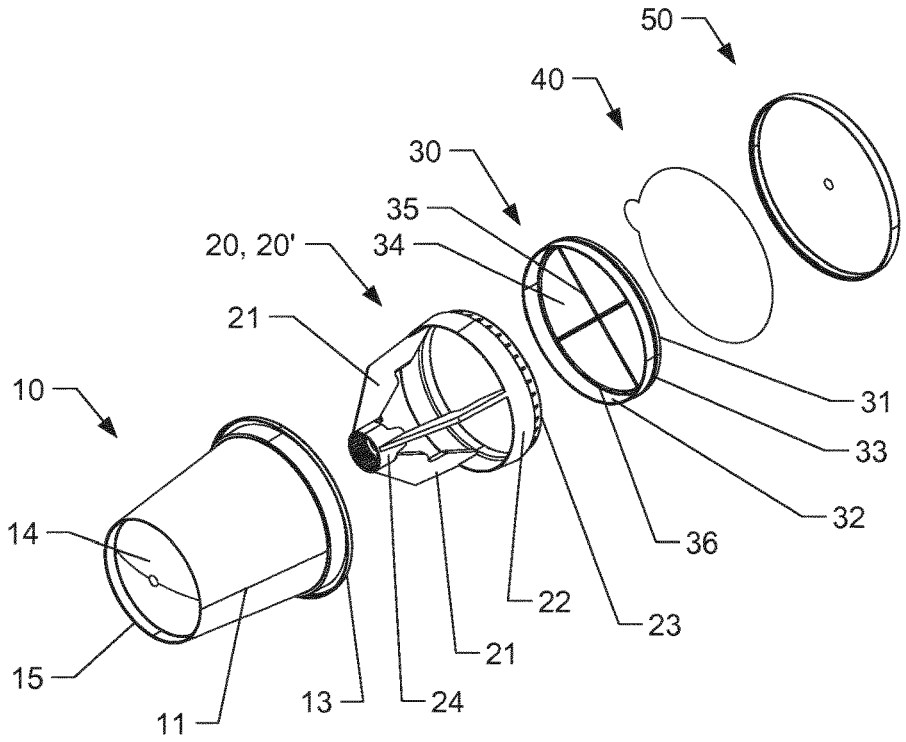
FIG. 2 is an exploded view of the plastic capsule on FIG. 1, additionally with sealing film and protective cover.
Figure 3:
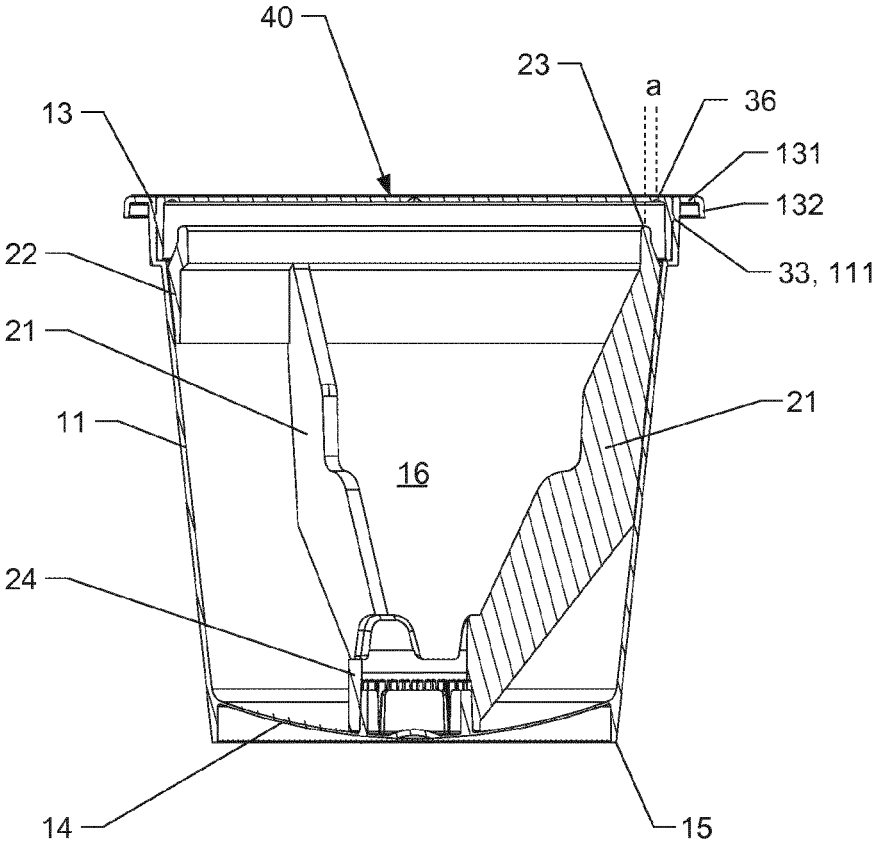
FIG. 3 is a sectional view of the plastic capsule on FIG. 1, additionally with sealing film and protective cover.
Figure 4:
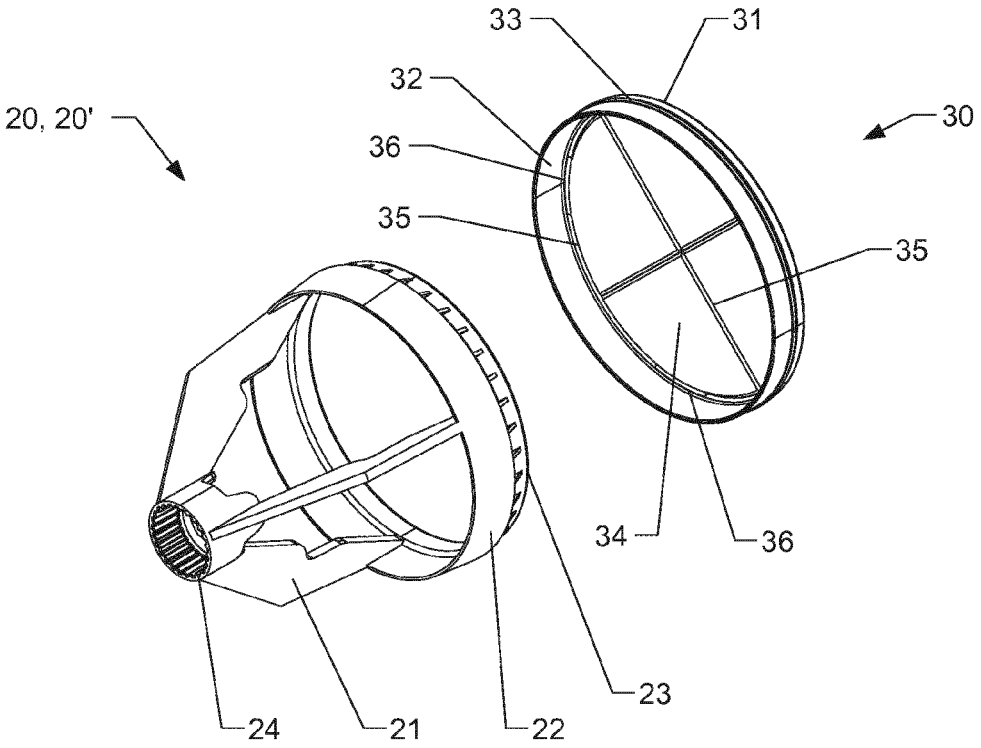
FIG. 4 is an exploded view of the dispensing device of the plastic capsule on FIG. 1.
Figure 5A:
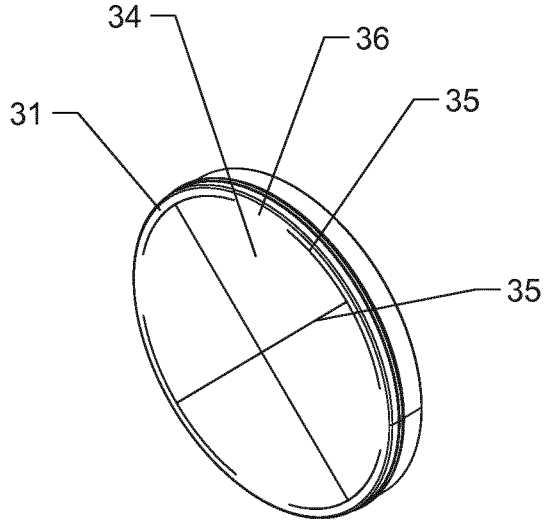
FIG. 5 is a perspective view of a capsule cover with flaps in the closed state (FIG. 5(*a*)) and in the open state (FIG. 5(*b*))
Figure 5B:
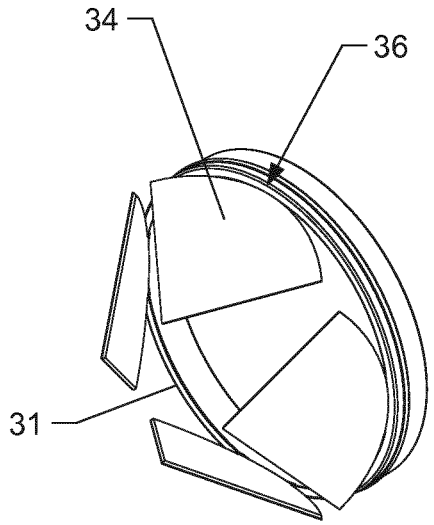
Figure 6:
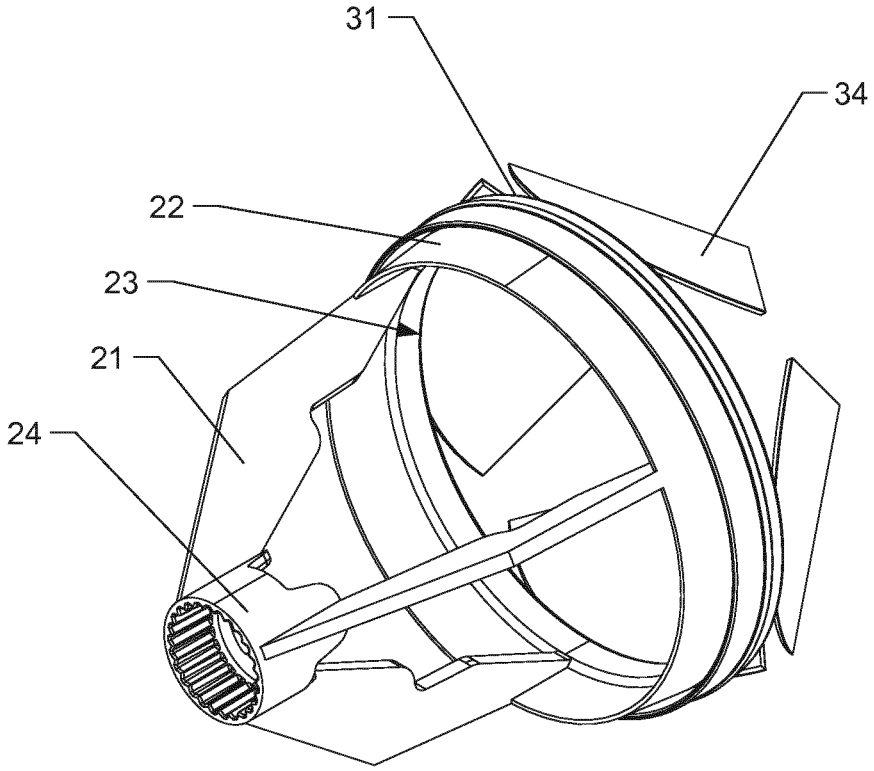
FIG. 6 is a perspective view of the dispensing device in the open state.

FIG. 1 shows a perspective view of a plastic capsule with integrated dispensing device. FIGS. 2 and 3 show an exploded view or a sectional view of the plastic capsule on FIG. 1. In the depicted embodiment, the plastic capsule 1 comprises a capsule body 10, an opening means 20 or an ejector 20', a capsule cover 30, a sealing film 30 and an optional protective cover 50. The sealing film 40 and protective cover 50 are not shown on FIG. 1. FIG. 4 only shows an exploded view of an ejector 20' and a capsule cover 30, which comprise parts of the dispensing device. FIGS. 5(*a*) and 5(*b*) show the capsule cover 30 in the closed state or the flaps 34 in a closed position (a) and in an open state or the flaps 34 in an open position (b). FIG. 6 shows the ejector 20' and an open capsule cover 30.

The capsule body 10 has an essentially conical capsule wall 11 with an upper capsule edge 13 forming a capsule opening 12 and a capsule bottom 14 arranged at the narrower, lower end of the capsule wall 11. The capsule bottom 14 can be rearwardly offset relative to the lower end of the capsule wall 11, so that it is surrounded by a continuous skirt 15 that protrudes over the capsule bottom 14. The capsule wall 11 and capsule bottom 14 comprise a capsule interior 16, which is additionally bordered by the capsule cover 30.

An ejector 20' is movably arranged in the capsule interior 16 in such a way that it can be moved along its longitudinal axis in the direction of a capsule cover 30 that covers the capsule opening 12. The ejector 20' and capsule cover 30 together comprise parts of the integrated dispensing device.

The capsule cover 30 for covering the capsule opening has a peripheral fastening edge 31. The capsule cover 30 can be fastened with the fastening edge directly to the upper end of the capsule wall 11, or—as in the depicted embodiment—have a continuous skirt 32 at the peripheral fastening edge 31 with a continuous bead 33 arranged on the peripheral outer surface. In order to fasten the capsule cover 30, the continuous bead 33 latches into a complementary groove 111 arranged on the interior surface of the capsule wall 11.

In the depicted embodiment of the capsule cover 30, four flaps 34 resembling uniform circle segments are formed by continuous slits 35 in the cover surface. These flaps 34 are each connected with the fastening edge 31 of the capsule cover 30 by way of a hinge 36, preferably a film hinge. Retaining webs that bridge the slits can be present between the flaps 34, and form predetermined breaking points.

The film hinges 36, which each retain the flaps 34 on the capsule cover 30, are arc-shaped in design. As a result, a restoring force acts on the flap 34 with the flap swiveled out, i.e., in the open position. If the ejector 20' is retracted again, the flaps 34 also close, at least partially.

In the depicted embodiment, the ejector 20' has three legs 21, which are connected with each other at an upper, additional end of the ejector 20' by way of a continuous ring 22. This ring 22 forms an annular stop surface 23 for pressing open the flaps 34 of the capsule cover 30. The stop surface 23 is radially inwardly offset by distance a (FIG. 3) in relation to the annularly arranged film hinges 36 of the capsule cover 36. This distance a between the hinge 36 and stop area on the flaps 34 is selected in such a way that, while the lever effect of the stop surface 23 on the flap 34 is high enough to deflect the flaps 34, already a slight movement by the ejector 20' in the direction of the capsule cover 30 causes a deflection of the flaps by approximately 90°, preferably by at least 60°, in relation to the planar initial position.

If the stop surface and radially outer edge of the flaps are annular in design, an outer radius of the stop surface can measure roughly 97% of the radius of the outer edge of the flaps.

The arms are connected with a connecting part at the lower end of the ejector 20'. As in the depicted embodiment, the connecting part can be designed like a coupling part 24, with which the ejector 20' is fastened to a complementary coupling part 141 on the interior side of the capsule bottom 14. In this way, the ejector 20' can be retracted back into the initial position by virtue of the curved capsule bottom bulging outwardly again after released.

The upper capsule edge 13 can further have a peripherally outwardly directed flange 131, on which a sealing film can be fastened. The flange 131 can also have a downwardly bent, continuous skirt 132 at the peripheral end. The flange can also be provided with a seal. The plastic capsule can be tightly held on a mixing container with the flange.

All parts of the capsule can be fabricated via injection molding technology. The capsule body preferably has a so-called barrier layer or gas barrier, so as to protect the substrate, e.g., against oxygen. For example, a capsule body with integrated barrier layer can be fabricated in a single step via co-injection.

The plastic capsule can further have an optional protective cover 50, which can be fastened via the capsule edge or the flange. This protective cover is only shown on FIG. 2.

In order to open the capsule, any sealing film 40 that might be present is first pulled off. The ejector 20' is activated by pressing in the flexible, curved capsule bottom 14, either by hand or with a device provided for this purpose. In the process, the ejector 20' moves in the direction of the capsule cover 30, and the stop surfaces 24 of the ejector 20' press the flaps 34 to the outside, in that the latter each swivel out around the hinges 36. The flaps 34 move from a closed position (FIG. 5(*a*)) into an open position (FIG. 5(*b*) and FIG. 6).

Figure 7:
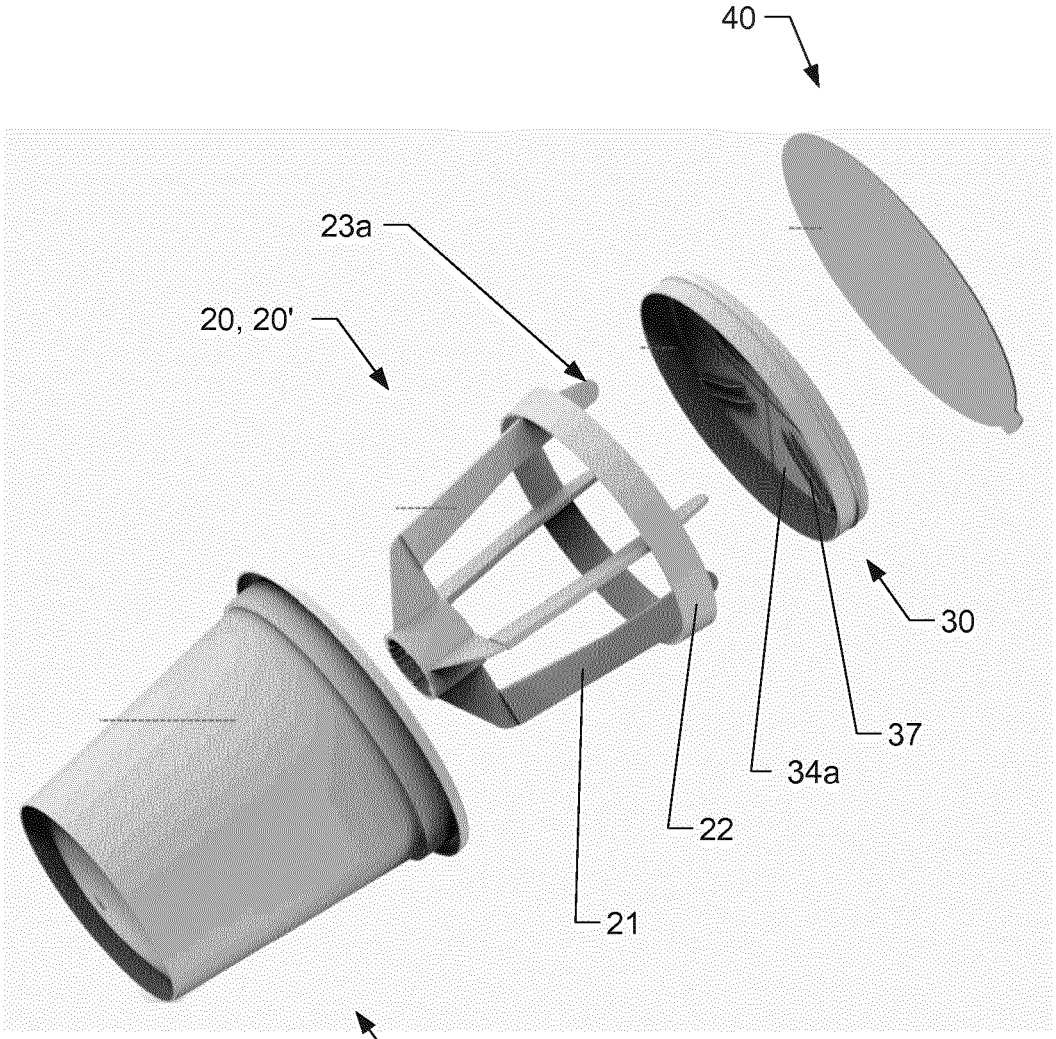
FIG. 7 is an exploded view of a plastic capsule with an additional embodiment of the dispensing device.

FIG. 7 shows a plastic capsule, whose ejector 20' has four arms 21, as opposed to the ejector 20' of the plastic capsule on FIGS. 1 to 6. The ring 22 is rearwardly offset relative to the end of the arms facing the capsule cover, so that each arm 21 forms a partial stop surface 23*a*. The ejector 20' and capsule cover 30 are aligned relative to each other in such a way that each arm 21 can press open a respective flap 34*a*. To this end, the interior side of each flap 34*a* can have a guide, e.g., in the form of molded on guide ribs 37, along which the cover-side end of the arm can be guided.

REFERENCE LIST

1 Plastic capsule
10 Capsule body
11 Capsule wall
111 Groove
12 Capsule opening
13 Capsule edge
131 Flange
132 Skirt
14 Capsule bottom
141 Coupling part
15 Continuous skirt
16 Capsule interior
20 Opening means
20' Ejector
21 Arm
22 Ring
23, 23*a* Stop surface
24 Coupling part
30 Capsule cover
31 Fastening edge
32 Skirt
33 Bead
34, 34*a* Flap
35 Slit
36 Hinge/film hinge
37 Guide ribs
40 Sealing film
50 Protective cover

The invention claimed is:

1. A plastic capsule having an integrated dispensing device for a substrate received in the plastic capsule, comprising a capsule body, an opening element and a capsule cover, wherein the capsule body and the capsule cover define a capsule interior for the substrate, in which the opening element is movable in a direction of the capsule cover; and wherein the capsule cover can be brought from a closed state into an open state by movement of the opening element; wherein the capsule cover has a peripheral fastening edge and several flaps connected with the peripheral fastening edge by respective hinges, wherein the movement of the opening element in the direction of the capsule cover deflects the several flaps around the respective hinges; and wherein the opening element includes at least one stop surface having an annular shape, wherein, upon activation of the opening element, contacts and presses against the several flaps causing the several flaps to swivel outwardly from the capsule interior, the at least one stop surface arranged offset radially inward in relation to the respective hinges.

2. The plastic capsule according to claim 1, wherein the several flaps are formed by slits in the capsule cover.

3. The plastic capsule according to claim 1, wherein the several flaps form uniform circular sectors of the capsule cover.

4. The plastic capsule according to claim 1, wherein the respective hinges are configured and arranged such that a restoring force acts on the several flaps in the open state of the capsule cover.

5. The plastic capsule according to claim 1, wherein the respective hinges are formed as curved fold lines along a circumference of the capsule cover.

6. The plastic capsule according to claim 1, wherein the capsule body includes a capsule wall having an upper capsule edge forming a capsule opening and a lower capsule bottom.

7. The plastic capsule according to claim 6, wherein the lower capsule bottom is configured and arranged as an outwardly curved and inwardly pushable membrane operatively connected with the opening element.

8. The plastic capsule according to claim 6, wherein the capsule body includes a skirt that circles around and protrudes over the lower capsule bottom.

9. The plastic capsule according to claim 6, wherein the lower capsule bottom and the opening element are connected via respective coupling parts.

10. The plastic capsule according to claim 6, wherein the capsule cover is retained on an interior surface of the upper capsule edge, and a planar surface of the capsule cover aligns flush with the upper capsule edge.

11. The plastic capsule according to claim 10, wherein the upper capsule edge includes an outwardly directed flange.

12. The plastic capsule according to claim 1, wherein the opening element is configured and arranged as an ejector, the ejector including several arms uniformly arranged around a longitudinal axis of the ejector.

13. The plastic capsule according to claim 1, wherein the respective hinges are film hinges.

14. The plastic capsule according to claim 11, further comprising a sealing film fastened to the outwardly directed flange.

15. The plastic capsule according to claim 12, wherein ends of the several arms are connected via a ring.

16. A plastic capsule having an integrated dispensing device for a substrate received in the plastic capsule, comprising a capsule body, an opening element, and a capsule cover, wherein the capsule body and the capsule cover define a capsule interior for the substrate, in which the opening element is movable in a direction of the capsule cover; and wherein the capsule cover can be brought from a closed state into an open state by movement of the opening element; wherein the capsule cover has a peripheral fastening edge and several flaps connected with the peripheral fastening edge by respective hinges, wherein the movement of the opening element in the direction of the capsule cover deflects the several flaps around the respective hinges; and wherein the opening element includes a plurality of stop surfaces, which, upon activation of the opening element, contact and press against the several flaps causing the several flaps to swivel outwardly from the capsule interior, the plurality of stop surfaces annularly arranged and offset radially inward in relation to the respective hinges.

17. The plastic capsule according to claim 16, wherein the opening element is configured and arranged as an ejector, the ejector including a plurality of arms uniformly arranged around a longitudinal axis of the ejector, wherein each arm of the plurality of arms forms a stop surface of the plurality of stop surfaces.

18. The plastic capsule according to claim 17, wherein an interior surface of each flap of the plurality of flaps includes guide ribs.

19. The plastic capsule according to claim 16, wherein the several flaps are formed by slits in the capsule cover and the respective hinges are formed as curved fold lines along a circumference of the capsule cover.

20. The plastic capsule according to claim 16, wherein the several flaps form uniform circular sectors of the capsule cover.

* * * * *